US006844686B1

(12) United States Patent
Schneck et al.

(10) Patent No.: US 6,844,686 B1
(45) Date of Patent: Jan. 18, 2005

(54) JEWELRY GIFT BOX WITH ILLUMINATED DISPLAY

(76) Inventors: Michael M. Schneck, 9475 Oak Leaf Way, Granite Bay, CA (US) 95746; Thomas J. Ingalz, 1528 Hallcrest Dr., San Jose, CA (US) 95118

( * ) Notice: Subject to any disclaimer, the term of this patent is extended or adjusted under 35 U.S.C. 154(b) by 0 days.

(21) Appl. No.: 10/628,624

(22) Filed: Jul. 28, 2003

(51) Int. Cl.[7] ..... H05B 37/00; H01L 27/14

(52) U.S. Cl. ..... 315/185 S; 315/200 A; 315/312; 362/800; 362/806

(58) Field of Search ..... 315/185 S, 200 A, 315/312, 324; 362/800, 806, 807, 808

(56) References Cited

U.S. PATENT DOCUMENTS

| | | | | |
|---|---|---|---|---|
| 1,851,746 A | * | 3/1932 | Wetherell | 206/557 |
| 3,937,320 A | | 2/1976 | Chao et al. | 206/75 |
| 5,329,433 A | | 7/1994 | Geeting et al. | 362/154 |

* cited by examiner

*Primary Examiner*—Tuyet Thi Vo
(74) *Attorney, Agent, or Firm*—Schneck & Schneck; Thomas Schneck; David M. Schneck

(57) ABSTRACT

A jewelry box including a pair of clamshell members joined by a hinge, a jewelry holder in one clamshell member and a display device in one clamshell member. The display device includes a LED light source, a light diffuser positioned over the light source, and a lighted display screen mounted over the light diffuser.

12 Claims, 3 Drawing Sheets

JEWELRY GIFT BOX WITH ILLUMINATED DISPLAY

TECHNICAL FIELD

The present invention relates to a jewelry gift box.

BACKGROUND OF THE INVENTION

Jewelry is commonly sold with an accompanying gift box to allow for an attractive presentation of the jewelry. In addition such a gift box prevents the jewelry from being tarnished. Such a gift box is commonly of a clamshell design with the jewelry, such as a ring, held by a support in the bottom section of the jewelry box. These boxes may be kept for jewelry storage or are disposable. Most commonly, the jewelry box has a top half and a bottom half connected by a hinge. The hinge usually holds the top and bottom half clamped shut, and upon opening provides a spring force, which holds the jewelry box open.

A number of prior devices have been proposed to add features to jewelry display boxes. For example, U.S. Pat. No. 3,937,320 discloses a box for holding a jewelry item. This box includes a small light bulb in a cop section of the jewelry box connected to a battery in the bottom section of the box. The hinge joining the top and bottom sections include a switch. The switch is activated by opening the box, closing a circuit to bring power to the bulb. Light is then directed by the bulb to the jewelry in the box.

U.S. Pat. No. 5,329,433 includes a high-intensity electric lamp in the top of the section of a hinged jewelry box. A reflector in the top section reflects additional light produced by the light source onto jewelry contained within the box. As in the previous device, a switch in the hinge allows closing a circuit, which connects the light source to a battery source.

It is an object of the present invention to provide a jewelry box with additional features that enhance the display of the jewelry within the box and provides a message displayed when the box is opened.

SUMMARY OF THE INVENTION

The above objects have been achieved with a jewelry display box including a first and second clamshell members joined by a hinge to define an interior volume for holding a piece of jewelry. An LED held by a holder in one of the clamshell members provides a light source having a columnar output beam. An optical light diffuser (such as a Fresnel lens and/or a holographic film) is mounted above the light source such that light from the LED is intercepted by the optical light diffuser. Above the optical light diffuser is mounted a transparent viewing screen. Light from the LED is dispersed by the light diffuser and then transmitted to the viewing screen.

The holder that holds the LED may be a circuit board, to which the LED may be surface mounted. The circuit board may include a battery electrically connected to the LED.

The Fresnel lens and other light diffusers may be formed on a planar member, which may be glass or a transparent, self-supporting polymer, or other frame.

The display screen may be a mask having clear and opaque portions, which may display a graphic or text message (as by having clear lettering in an opaque field or by contrasting lettering). The jewelry box may be palm sized.

DETAILED DESCRIPTION OF THE INVENTION

Figure 1:
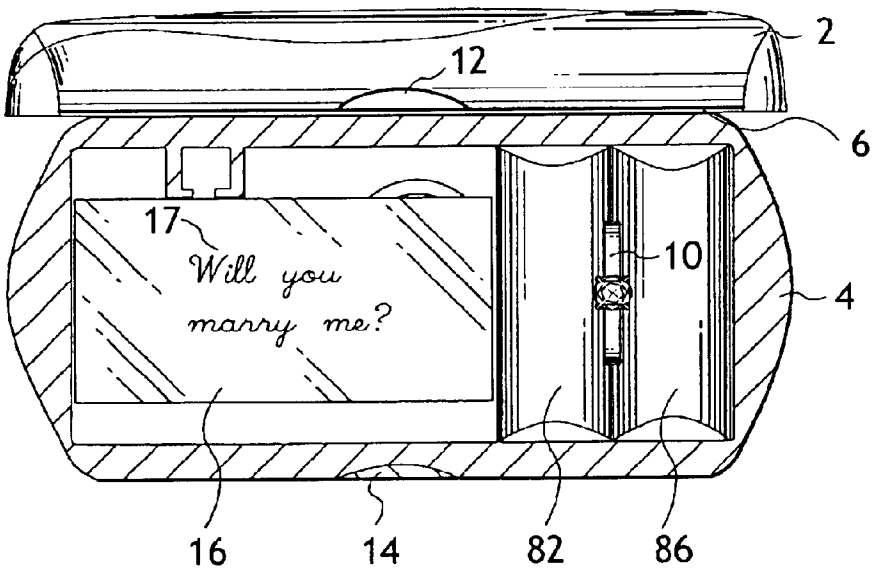
FIG. 1 is a top view of an open jewelry box of the present invention.

With respect to FIG. 1, the jewelry box of the present invention includes a first clamshell member 2 and a second clamshell member 4 joined by a hinge 6. The hinge may be a leaf spring fabric hinge or other similar device. A spring hinge would hold the first and second member in an open position. When opposing force is applied to the first and second members, the box would close while the hinge spring would retain the members in a clamped shut position. A finger grip 12 on first member 2 and a finger grip 14 on second member 4 aid in opening the box. Both first member 2 and second member 4 have a concave structure such that the members, joined by hinge 6, define an interior space of the jewelry box. The interior of first member 2 and second member 4 may be lined in a fabric, such as velvet, to enhance the aesthetic quality of the box.

Inside second (bottom) member 4, an area of the jewelry box contains a holder for the jewelry. As pictured, ring supports 8*a*, 8*b* hold ring 10. Ring supports 8*a*, 8*b* may be fabric covered resilient polymer, which may slightly deform to hold ring 10. This jewelry holding area could alternatively have a flat surface having one or more holes extending through the surface. This would allow earrings to be secured through the holes, or a necklace, bracelet or wrist watch to be inserted through the holes to display a gem or pendant hung from the necklace. This flat surface could be a plastic, cardboard or metal panel, preferably covered with velvet or other material.

Also within one of the clamshell members 4 is the interchangeable display screen 16. This display screen may display a text message 17, a graphic or some other visual to accompany the presentation of the jewelry to a recipient and may be interchanged with other display screens.

Figure 2:
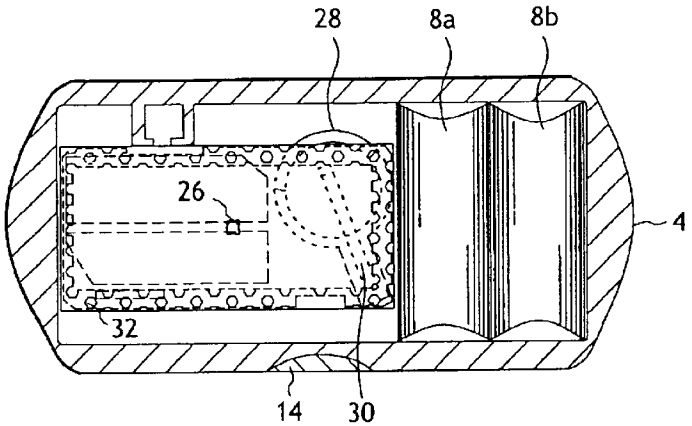
FIG. 2 is a top view of the bottom section of the jewelry box of FIG. 1.
Figure 3:
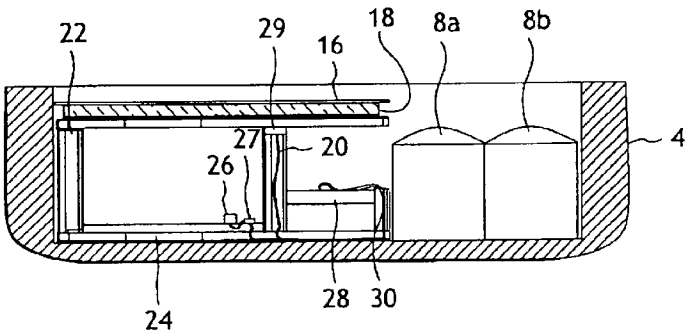
FIG. 3 is a side cross section of the jewelry box of FIG. 2.

FIG. 2 and FIG. 3 illustrate the workings of the lit display. Within clamshell member 4, ring supports 8*a* and 8*b* are mounted, such that each of ring supports 8*a*, 8*b* are sufficiently below the open top of member 4 to allow for the height of a ring or other piece of jewelry to be accommodated.

Also inserted into clamshell member 4 is a display device that may display a message or image when the jewelry box is opened. This device may be manufactured as a single, drop-in component that would be inserted into the jewelry box. This would simplify the manufacturing of this device. The component would be secured into the jewelry box by adhesive, ultrasonic welding, clips, or other attachment means. The display screen may be fixed part of this component or may be an insertable, interchangeable part. An interchangeable display screen could be secured by an attachment means.

The display device includes a circuit board 24 connected to two side supports 20, 22. Connected onto circuit board 24 is an light emitting diode (LED) 26, a resistor 27, a switch 29 and a battery terminal 30.

The LED may be a commercially available blue LED (emitting light having a 470 nm wavelength), which is a bright, long lived light source. A wavelength filter may be used with a blue LED to produce white light. The LED may be a surface mounted integrated phosphor type or a phosphor filled silicone type, among others.

Battery 28 provides a power source to LED 26, with current directed through resistor 27. A blue LED forward voltage is about 3.6 volts, so the battery source must supply at least this much voltage to support the LED at its brightest service. Two 3 volt energy cells connected in series could be adopted as the energy cell. Alternately a single cell may be used which limits LED current to a safe level. Another alternative is to use a switching or change pump LED driver chip. These are commercially available, more energy efficient and relatively inexpensive. This component can extend useful battery life while allowing good illumination as the cell progresses deep into its depletion cycle.

A switch 29 activates the LED 26 when the jewelry box is opened a Hall effect switch having a magnet partner in the first member 4 and a metal portion in the second member is closed. This completes a normally open circuit, allowing electricity from the battery 29 to flow to LED 26. A Hall effects switch provides a simple switch having a very long life. Alternatively a magnetic reed switch may be used. This switch is normally open when the jewelry box is open. Shutting the box turns off this switch. Such normally open switches are commercially available in many styles at relatively low cost. A normally closed read switch could also be used.

Mounted on side supports 20, 22 are optical elements of the inserted display device. Light from LED 26 impinges on light diffuser 18. Light diffuser 18 may be a Fresnel lens or other diffusing lens that diffuses the light from LED 26. The Fresnel lens may be formed on a planar member, such as glass or a self supporting polymer. Commercially available Fresnel lenses may be obtained having focal lengths of 16 mm or 19 mm, with light diffused to a 1 inch by two inch or 25 mm by 50 mm window respectively. Such lenses may be made by two part injection molding, not stamped or engraved glass. The lens is secured to side support 20, 22 and attached at the edges of the lens. The lens is positioned at its focal distance from the LED 26 light source.

An alternative light diffusion device would be a hologram filter. A rear projection film hologram may be used to provide an even illumination. A 25×95 degree light shaping diffuser hologram could be used. The Hologram filter would be placed on the side supports 20, 22 to intercept light from the LED 26. A single holographic film could act as a light diffuser and as the display screen for display of a message.

Mounted above the light diffusion device is a display screen 16 lit by the light transmitted through the light diffuser. The display screen may have a text or graphic image that is lit by light from LED 26. The display screen may be made of two bonded planes, one transparent and one opaque. A mask over the opaque lens could create the outline of the text or graphic. The display screen may be a thin laminated plastic sheet mounted over the light diffusion optics on supports 20, 22.

Figure 4:
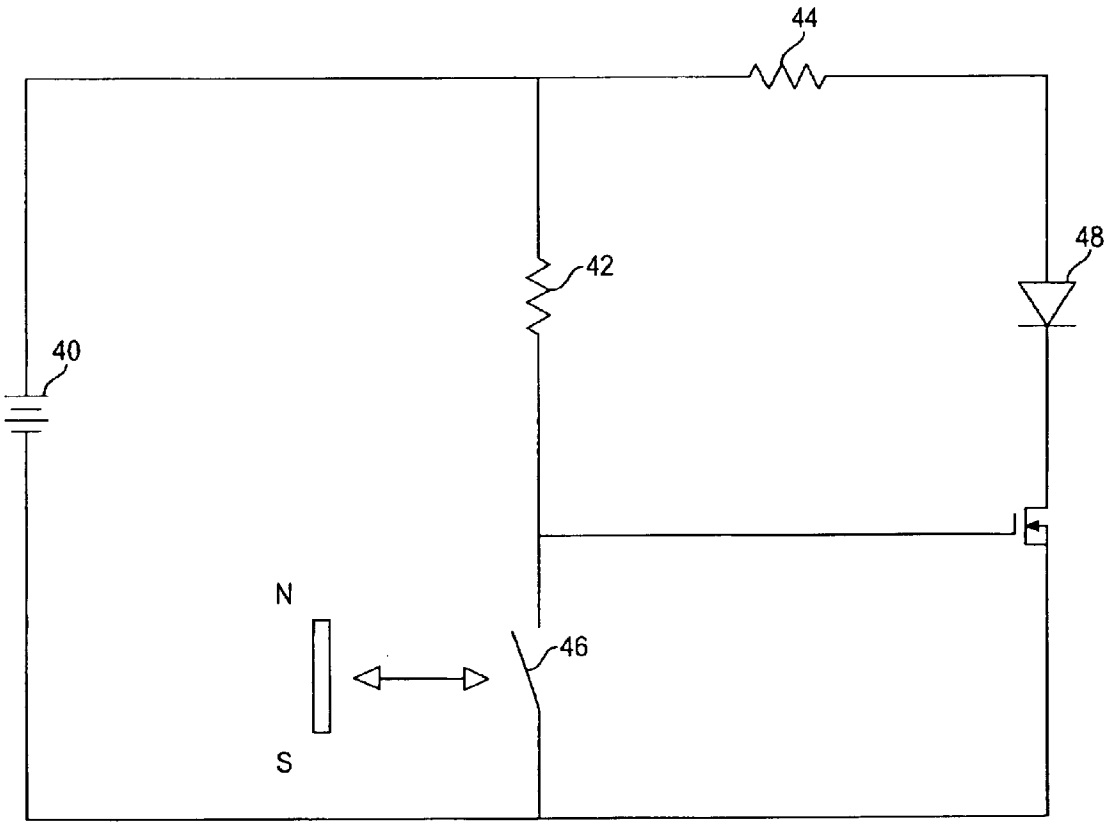
FIG. 4 is a electrical schematic of the electronic elements of the device of FIGS. 1–3.

FIG. 4 shows the electrical diagram of the elements of the present system. Battery 40 is joined to the LED 48 by a pathway including a first resistor 44 and a second resistor 42 connected in parallel. When switch 46 is closed the circuit is completed and power from battery 40 may flow to LED 48.

What is claimed is:

1. A display box comprising:

a first and second clamshell members;

a hinge connecting said clamshell members such that the members are capable of openings and closing, said members defining a clamshell volume therewithin;

a jewelry holder, mounted in the first member;

a LED having an output beam mounted in said first clamshell member;

an optical light diffuser spaced apart from the LED, within the first member positioned to intercept the output beam and limiting light divergence therefrom; and a display screen lit by the light from the output beam.

2. The box of claim 1 wherein the light diffusion device includes a hologram.

3. The box of claim 1 wherein the display box includes a switch activated by opening said box.

4. The box of claim 1 wherein said LED is mounted on a circuit board.

5. The box of claim 4 wherein said LED is surface mounted.

6. The box of claim 4 wherein the circuit board supports a battery electrically connected to the LED.

7. The box of claim 1 wherein said light diffusion device is a Fresnel lens formed on a planar member.

8. The box of claim 7 wherein the planar member is glass.

9. The box of claim 7 wherein the planar member is a clear, self-supporting polymer.

10. The box of claim 1 wherein the display screen includes a mask having clear and opaque portions.

11. The box of claim 10 wherein the mask displays a text message.

12. The box of claim 11 wherein the message in the mask is clear lettering in an opaque field.

* * * * *